United States Patent [19]

Wood

[11] 4,156,592

[45] May 29, 1979

[54] EXPANDABLE FABRIC SOFTENER-CONTAINING ARTICLE AND USE THEREOF

[75] Inventor: Louis L. Wood, Rockville, Md.

[73] Assignee: W. R. Grace & Co., New York, N.Y.

[21] Appl. No.: 927,211

[22] Filed: Jul. 24, 1978

Related U.S. Application Data

[63] Continuation-in-part of Ser. No. 787,929, Apr. 15, 1977, abandoned.

[51] Int. Cl.[2] ..... D06M 13/46

[52] U.S. Cl. ..... 8/137; 206/.5; 252/8.8; 264/134; 264/321; 427/244; 428/279; 428/311

[58] Field of Search ..... 427/242, 244; 8/137, 8/159; 15/104.93; 252/91, 8.8; 428/279, 311; 264/321, 134; 206/.5

[56] References Cited

U.S. PATENT DOCUMENTS

| | | | |
|---|---|---|---|
| 3,306,966 | 2/1967 | Matejcek et al. | 264/321 |
| 3,325,338 | 6/1967 | Geen | 427/244 X |
| 3,369,544 | 2/1968 | Crockford | 19/144.5 X |
| 3,390,106 | 6/1968 | Geen et al. | 264/321 X |
| 3,686,025 | 8/1972 | Morton | 252/91 X |
| 3,903,232 | 9/1975 | Wood et al. | 15/104.93 X |

*Primary Examiner*—Evan K. Lawrence

*Attorney, Agent, or Firm*—Richard P. Plunkett; William W. McDowell, Jr.

[57] ABSTRACT

Disclosed herein is a fabric softener-containing article comprising a fabric softener impregnated into an open-celled reticulated urethane foam; said impregnated foam being compressed to form a sheet or wafer. The fabric softener also acts as a solid binder which maintains the reticulated urethane foam in compressed form. The compressed sheet-like compositions are especially advantageous in that they are only 1/5 to 1/15 the size of comparable materials containing equivalent loadings of fabric softener. During the laundry wash cycle the water-dispersible fabric softener is released allowing the foam to slowly rebound to substantially its original uncompressed shape.

10 Claims, No Drawings

EXPANDABLE FABRIC SOFTENER-CONTAINING ARTICLE AND USE THEREOF

This application is a continuation-in-part of my copending application having Ser. No. 787,929, filed Apr. 15, 1977, now abandoned.

BACKGROUND OF THE INVENTION

Certain chemical compounds have long been known in the art to possess the desired quality of imparting softness to textile fabrics. The quality of softness or being soft is well defined in the art and, as used herein, means that quality of a treated fabric whereby its handle or texture is smooth, pliable and fluffy and not rough or scratchy to the touch. Known generally as "softening agents," "fabric softeners" or "softeners," these compounds have long been used by housewives in the laundry and by the textile industry to soften a finished fabric.

Softening agents are usually employed in liquid formulations, and powder, tablet and granular formulations are known. Use of these compositions results in many inconveniences. For example, housewives very often forget to add the softening agent during the rinse cycle of the washing process, thereby necessitating repeated rinse cycles until the softener is timely remembered and added. Additionally, these softening compositions are not generally premeasured; the result is that the housewife often uses an amount insufficient to adequately soften the fabrics or she wastes the softening composition by using excessive amounts or by spillage.

The prior art suggests incorporating fabric softeners into fabric-like substrates, e.g., felted or woven materials such as paper toweling and swatches of cloth or absorbent sponges. In U.S. Pat. No. 3,442,692 a process is described whereby a sheet composed of the above materials and carrying the fabric softener is placed in a laundry drier together with washed, but still wet, fabrics such as sheets, garments, pillow cases, etc.

Impregnated substrates for use in laundering applications are also described in U.S. Pat. No. 3,686,025. In the last mentioned patent the absorbency of the substrate is closely controlled so that release of the impregnated fabric softener occurs slowly and uniformly coats the fabric. Numerous fabric softeners are disclosed along with materials such as sponges, paper and nonwovens as substrates. The preferred substrates are cellulosic materials.

SUMMARY OF THE INVENTION

The invention is a compressed reticulated urethane foam impregnated with and bound in its compressed state by a fabric softener and the method of using the same in a laundry wash cycle. The softener has a softening point in excess of about 38° C. and is water-dispersible at temperatures of from about 20° to about 85° C. Impregnation rather than coating of the foam is essential and critical. The term "impregnation" is intended to mean the permeation of the entire foam structure, internally as well as externally. To permit this impregnation, the foam structure must be reticulated. A reticulated foam in one wherein the cell is made up solely of ribs without any membrane there between. As is well known, reticulated foams differ from open cell foams in that they are more resilient and thus after compression return substantially to their uncompressed state. Thus, to maintain reticulated foams in a compressed state, it is necessary to use a binder. In the instant invention the fabric softener has two functions, namely, to act as a binder to maintain the reticulated urethane foam in its compressed state prior to use and as a fabric softener when contacted with water in laundering and other similar applications. Reticulated foam, because of its substantially completely open cell structure, is the preferred substrate for the fabric softener since it allows the liquid, e.g., water, almost substantially complete flow through, thereby utilizing the water-dispersible fabric softener to its utmost. Thus, by the proper selection of a water-dispersable fabric softener which has a softening point in excess of about 38° C., a reticulated foam can be bound in a compressed state therewith at ordinary temperatures and will regain its resiliency when contacted with water, thereby releasing the fabric softener to uniformly coat the fabrics to be softened.

DESCRIPTION OF THE PREFERRED EMBODIMENTS

The impregnated foam matrix is compressed to 1/5 to 1/15 of its original thickness. Generally, as employed in the present invention, the compressed sheets or wafers have a thickness of from about 0.01 to about 0.25 inches.

The fabric softener employed should have a softening point in excess of about 38° C. Such types of materials are therefore solid at room temperatures or temperatures commonly encountered in shipment and storage of the compressed foams. The solid fabric softener acts as a binder to maintain the reticulated foam in a compressed state in the form of a thin, space-saving wafer or sheet. Another requirement of the fabric softener is that it be water-dispersible at temperatures normally encountered in the washing cycle of an automatic washer, e.g., from about 20° to about 85° C.

The fabric softeners of the instant invention are water-dispersible. As used herein, the term "water-dispersible" means that on contact with water the material is substantially uniformly distributed throughout the water phase. The fabric softeners may also be water-soluble to a high to medium or even low solubility extent. The exact water solubility of a particular fabric softener at a particular temperature is not critical so long as it is sufficient to yield the amount of fabric softening activity desired.

The mechanism responsible for achieving the numerous advantages of the invention involves several steps. First the reticulated, urethane foam loaded with fabric softener is compressed to the desired thickness. The fabric softener functions as a solid binder maintaining the foam in its compressed configuration. Upon immersion in water in the washing or rinsing cycle during laundering, the fabric softener is slowly removed and dispersed, thereby allowing the foam to regain its original unpressed configuration. The water dispersibility of the fabric softener removes it as a binder and allows the foam to pop back to its original configuration, thereby rendering more fabric softener available than would be expected, e.g., 80–100% of the fabric softener is ordinarily released. The rebound of the compressed reticulated foam is desirable as it permits greater water flow through, thus releasing more fabric softener. This process takes place relatively slowly which may account for the fabric softening action in clothes even though the composition is administered at the beginning of the wash cycle. As aforestated, the urethane foam employed is reticulated, i.e., the foam cells consist essentially of interconnecting string-like elements (ribs) with the normal foam membrane being substantially absent.

Such reticulated foams still possess the essential resilience or rebound feature, yet the lack of a cell membrane contributes to the availability of the fabric softener in laundering.

The wafer or sheet-like products of the invention possess numerous advantages. A principal advantage is that the products are thin and easily packaged and stored, thereby offering considerable space-saving advantages over bulky liquids or powders which must be stored in boxes or other bulky containers. Another significant advantage is that the tendency of the foams to "pop" open or slowly return to their original uncompressed configuration contributes to good release of fabric softener from the foam. Therefore, the resiliency of the foam upon release of the fabric softener binder in the machine wash environment is a very desirable feature in the foams. A further significant advantage is that the compressed foam products of the invention can be added at the beginning of the washing cycle as well as at the beginning of subsequent rinse steps. This unexpected ability of the foams to slowly release the fabric softener while popping open to regain their original shape provides an unexpected convenience to the housewife. Conventional fabric softeners must be added either at the beginning of the rinsing step or during the drying cycle to avoid being washed from the clothes. Optimally, the sheet-like compositions of the invention will be added at the beginning of the rinse cycles although considerable effectiveness is achieved when the compositions are added at the beginning of the washing cycle. A further advantage is that the fabric softener is provided in a predetermined measured amount. The types of fabrics which can be conditioned with the compositions include all those normally employed with conventional fabric softeners, e.g., cotton, polyester, rayon, nylon, etc.

The term "softening point" as used herein is defined in U.S. Pat. No. 3,686,025 and means the temperature at which the fabric softener, impregnated into the foam, becomes dispersed and mobile and/or soluble enough to leave the foam and adhere to fabrics contacting the softener-impregnated foam.

Determination of softening points of fabric softeners impregnated into foams according to the invention can be made by continually passing water, the temperature of which is constantly measured by a thermometer or temperature gauge, through a 1" diameter metal pipe which has a thoroughly clean and polished surface and about which a sheet of a softener-impregnated foam has been tightly wrapped. The surface of the pipe equilibrates with the water temperature, and the water temperature is raised until a marked change is observed in the composition of the foam. This change is characterized by the compressed foam sheet being damp to the touch, by the ability to now slide the sheet along the pipe and by the pipe feeling "lubricated" on removal of the foam sheet. The water temperature at which this change is observed is the softening point of the fabric softener. The softening point will generally be between about 35° C. and about 60° C. and will be less than about 85° C. Softening points in excess of 85° C. can be useful if the softener is soluble in water.

A preferred feature of the foams employed is that in addition to being resilient and reticulated the foam should also be hydrophilic. It should be understood that the feature of hydrophilicity is not critical insofar as activity but is preferred in that the activity of the fabric softener compositions will be increased. Hydrophilicity of the foam contributes to better absorbency or imbibing of the aqueous phase in the foam, thereby aiding in the release of the fabric softener. Also, during the wash cycle hydrophilicity of the foam increases the access of the internal portions of the foam to water. A hydrophilic foam, for example, will generally absorb water into the foam matrix. As employed in the present invention, the term "hydrophilic" is intended to mean foams which can absorb up to 2 to 5 times their weight of water in the solid polymer backbone (ribs) itself in addition to the water just held in the voids or interstices of the foam cells.

The amount of fabric softener incorporated into the foam should be sufficient to be effective while a substantial excess thereof serves no purpose and is thus uneconomical. The actual amount to be effective is variable and depends on the nature of the softener employed. This amount can be readily determined by loading foams with various fabric softeners at various levels and actually conducting simulated washing trials. Generally, a foam sheet measuring 25 in.$^2$ to 10 in.$^2$ by $\frac{1}{8}$" to $\frac{1}{4}$" in thickness prior to compression should contain from about 3 to about 12 g of fabric softener.

The method of preparing the loaded foams and subsequent compression to sheet-like form is fairly conventional. Generally, the fabric softener is applied as a hot melt or as an aqueous dispersion, emulsion or solution by spraying onto the foam or immersing the foam in the fabric softener or roller coating. Subsequently, if aqueous methods of adding the fabric softener have been used, the loaded foam is dried, e.g., by heating the foam at from about 50° to about 110° C. for about 1 to about 5 hours depending, of course, on the thickness of the foam and the amount of water employed in the fabric softener dispersion. Radio frequency (microwave) drying can also be used to effect drying in a matter of minutes. Subsequently, the dried foam is compressed using heated rollers, hot plates or other conventional means to from about 1/15 to about 1/5 of its original height. The initial compression step is carried out at a temperature above the softening point of the fabric softener in order that it is sufficiently fluid to act as a binder to maintain the reticulated urethane foam in a compressed state. Thereafter, during compression, the temperature is lowered below the softening point of the fabric softener to insure that it will bind and maintain the foam in its compressed state. The thus compressed reticulated urethane on subsequent contact with water will release the fabric softener binder and rebound to substantially its uncompressed state. Following compression as described above, the foam sheets or wafers have a thickness of about 0.01 to about 0.25 (preferably 0.025" to 0.125") and also have a waxy feel.

Other additives can also be used in combination with a softening agent. Although not essential to the invention herein, certain of these additives may be desirable and useful, e.g., perfumes and brightening agents; shrinkage controllers and spot removing agents.

Fabric softeners which can be employed include those conventionally used. A comprehensive list is included in U.S. Pat. No. 3,686,025 incorporated herein by reference. Fabric softeners taught in this patent can be employed in the present invention to the extent that they satisfy the criteria set forth above. Generally, the fabric softeners can be grouped into the following classes which contain compounds having at least one long chain group:

(1) cationic quaternary ammonium salts including quaternary imidazolinium salts;
(2) non-ionic compounds, such as tertiary phosphine oxides, tertiary amine oxides and ethoxylated alcohols and alkylphenols;
(3) anionic soaps, sulfates and sulfonates, e.g., fatty acid soaps, ethoxylated alcohol sulfates and sodium alkyl sulfates, alkyl sulfonates, sodium alkylbenzene sulfonates and sodium or potassium alkylglycerylethersulfonates;
(4) Zwitterionic quaternary ammonium compounds;
(5) ampholytic tertiary ammonium compounds; and
(6) compatible mixtures of one or more compounds of these classes.

The preferred type of polyurethane foam is a hydrophilic foam prepared by admixing very large amounts of water with a urethane prepolymer. The mixing conditions, water employed, etc., are described in U.S. Pat. No. 3,903,232, incorporated herein by reference.

Urethane prepolymers useful in preparing the preferred polyurethane foam are prepared by capping a polyoxyalkylene polyol with an excess of polyisocyanate, e.g., toluene diisocyanate. Prior to capping the polyol should have a molecular weight of from about 200 to about 20,000 and preferably from about 600 to about 6,000. The hydroxyl functionality of the polyol and the corresponding isocyanate functionality following capping is from 2 to about 8. If foams are formed from prepolymers with an isocyanate functionality of about 2, the resulting product is essentially linear and does not have as much tensile strength as if it was crosslinked. Accordingly, a hydroxyl content greater than two per molecule is desired. This can be obtained by using mixtures of diols with triols or other higher functionality polyols, or triols or other higher order polyols, per se, can be capped with di- or polyisocyanates.

Examples of suitable polyols (to be capped with polyisocyanates) include: (A) essentially linear polyols formed for example by reaction of ethylene oxide with ethylene glycol as an initiator. As discussed above, mixtures of ethylene oxide with other alkylene oxides can be employed so long as the mole percent of ethylene oxide is at least 40 percent. Where the linear polyethers are mixtures of ethylene oxide with, e.g., propylene oxide, the polymer can be either random or a block copolymer and the terminal units can be either oxyethylene or oxypropylene. A second class of polyol (B) includes those with a hydroxy functionality of 3 or more. Such polyols are commonly formed by reacting alkylene oxides with a polyfunctional initiator such as trimethyolpropane, pentaerythritol, etc. In forming the polyol B, the alkylene oxide used can be ethylene oxide or mixtures of ethylene oxide with other alkylene oxides as described above. Useful polyols can be further exemplified by (C) linear branched polyfunctional polyols as exemplified in A and B above together with an initiator or crosslinker. A specific example of C is a mixture of polyethylene glycol (m.w. about 1,000) with trimethylolpropane, trimethylolethane or glycerine. This mixture can be subsequently reacted with excess polyisocyanate to provide a prepolymer useful in the invention. Alternatively, the linear or branched polyols (e.g., polyethylene glycol) can be reacted separately with excess polyisocyanate. The initiator, e.g., trimethylolpropane, can also be separately reacted with polyisocyanate. Subsequently, the two capped materials can be combined to form the prepolymer.

Suitable polyisocyanates and initiators are set forth in U.S. Pat. No. 3,903,232 described above and incorporated herein by reference. The initiators are generally water-soluble or water-dispersible crosslinking agents as described in U.S. Pat. No. 3,903,232. Unless otherwise noted, all parts and percentages are by weight.

EXAMPLE 1

Hydrophilic Prepolymer

A hydrophilic prepolymer was prepared by admixing 2 molar equivalents of polyethylene glycol having an average molecular weight of 1,000 (PEG—1,000) and one molar equivalent of trimethylolpropane (TMOP). The admixture was dried at 100°-110° C. under a pressure of 5-14 Torr to remove water. The resulting dried mixture was slowly added over a period of about one hour to a vessel containing 6.65 molar equivalents of toluene diisocyanate (TDI) while stirring the TDI and polyol mixture. The temperature was maintained at 60° C. The mixture was maintained at 60° C. with stirring for three additional hours. During this reaction period some chain extension occurs since insufficient TDI is present in the system to allow only one of the NCO groups/TDI molecule to react with the OH groups in the polyols present. Thus, some of the TDI has both NCO groups reacted with OH groups resulting in a chain extended prepolymer. Thereafter, an additional 1.05 molar equivalent of TDI was added with stirring over a period of about one hour while maintaining the temperature at 60° C. The final reaction mixture contained a 10% molar excess of TDI. All hydroxyl groups were capped with isocyanate and some chain extension occurred due to both NCO groups on a TDI molecule reacting with OH groups on a polyol.

EXAMPLE 2

A reticulated hydrophilic foam was prepared from the above prepolymer by admixing (on a weight basis) 95 parts of the hydrophilic prepolymer from Example 1, 5 parts of toluene diisocyanate and 7 parts of blowing agent (Freon-11—a product of E. I. DuPont & Co.). To the above was added an aqueous dispersion of 47 parts water, 1.3 parts of a polyether surfactant (Pluronic-75, BASF Wyandotte), 0.3 parts of n-alkyl morpholine (Thancat DD—Jefferson Chemical Co.) and 0.3 parts of blue pigment (Calcotone Blue—American Cyanamid). The aqueous phase was admixed with the prepolymer phase and allowed to foam. The foam had a dry density of 1.1 lbs/ft$^3$ and was reticulated, i.e., the foam consisted primarily of interconnecting ribs with the usual cell membrane structure being essentially absent.

EXAMPLE 3

Examples of the Invention

Sheets were prepared from the reticulated hydrophilic foam prepared in Example 2. The sheets measured about 5"×5"×0.25" and weighed about 1.2-1.5 g with a sensity of about 1.1 lbs/ft$^3$. Each sheet was allowed to "soak-up" or imbibe a 50/50 aqueous dispersion of a fabric softener. The particular fabric softener employed was a ditallow dimethyl ammonium chloride salt wherein the tallow groups were hydrogenated (i.e., hardened). The loaded foam contained from 6.5-8.5 g of the fabric softener and was dried. The dried foam was pressed between plates at about 100°-150° C. using less than about 100 psi of pressure followed by cold (25° C.) pressing at 50-500 psi. Using this process as outlined above, reticulated foam sheets were converted to thin translucent, waxy sheets and bound in this compressed state by approximately 8 g of fabric softener.

EXAMPLE 4

A 5"×5"×0.125" sheet of foam weighing 1.2–1.5 g, prepared as described above and containing 6.5–8.5 g of the quaternary ammonium fabric softener was folded over into two equal parts and pressed into 5"×2.5"×0.02" wafers using the process described in Example 3. The wafers were added to an automatic washing machine at the start of the wash cycle. The water temperature at the time of addition was approximately 60° to 70° C. The foam sheets were removed at the end of the washing process (wash cycle plus two rinse cycles) and had regained their original expanded shape prior to pressing but only 14–65 weight percent of the fabric softener had been released. Such folded sheets could be employed but are not as efficient as unfolded sheets prepared as described below. The decreased efficiency is believed to be due to shielding of the folded layers so that the internal portions of the folded composite are not as accessible to the wash water as in the case of unfolded sheets.

EXAMPLE 5

A 5"×5"×0.125" reticulated foam sheet containing from 6.5–8.5 g of the quaternary ammonium fabric softener was compressed as described in Example 4 but, without folding, to provide a wafer having dimensions of 5"×5"×0.0125". Washing machine trials revealed that 60–85 weight percent of the fabric softener was released. The trials were conducted under conditions comparable to those described in Example 4.

EXAMPLE 6

A 5"×2.5"×0.25" sheet of the reticulated foam loaded with 6.5–8.5 g of the quaternary ammonium fabric softener was compressed as in Example 3 without folding to yield a slightly expanded sheet measuring 7"×5"×0.03". Washing machine tests as set out in Example 4 showed that 87–98% of the fabric softener was removed.

EXAMPLE 7

A 5"×5"×0.125" sheet of commercial hydrophobic poly(ether) urethane foam (weight about 1.5 g, density of 1.0 lbs/ft$^3$) was impregnated with 6.5–8.5 g of the quaternary ammonium fabric softener and was dried and pressed as described in Example 3 to provide wafer-like sheets having dimensions of 5.25"×5.25"×0.02". The washing machine test of Example 4 showed that 96–100% of the fabric softener was removed.

In Examples 5–7 above, the clothes used in the washing trials were, after washing, substantially free of static charges and had a soft feel resulting from the action of the fabric softener. Also, all of the foams except for the folded composites returned to their original shape and were easily removed and dried

EXAMPLE 8

In addition to applying the fabric softener to the foam as an aqueous slurry, the fabric softener was also applied in the form of a "hot-melt." Sheets (2.5"×5.0"×0.25") of reticulated hydrophilic foam (density 1.5 lbs/ft$^3$, weight about 1.4–1.5 g), formed by the reactants and procedure of Examples 1 and 2, were placed between two sheets of linen coated with a polyfluorocarbon (Teflon—E. I. DuPont & Co.) along with 10 g portions of fabric softener (melting point 55°–57° C.). This sandwich configuration was placed in a hot press at 100°–120° C. and very lightly (less than 10 psi) pressed for about 5 seconds. Thereafter the composite was further compressed at 25° C. for 20–30 seconds at pressures approaching 50 psi. Upon removal of the Teflon coated sheets, the compressed foam bound in its compressed state by the fabric softener was in the form of wafers measuring about 2.75"×5.2" with a thickness of about 0.05" to 0.025". The wafers had a waxy feel and were trimmed to give sheets weighing from 6–10 g apiece.

One of the above wafers weighing 9.4 g (1.4 g of foam plus 8.0 g of fabric softener) was placed in an automatic washing machine at the start of the wash cycle (permanent press cycle, warm water) along with a liquid detergent. At the end of the wash cycle, the foam was recovered intact and weighed (dry) 1.4 g, thus 100% (8.0 g) of the fabric softener was removed. The resultant washed clothes upon drying were essentially static-free and exhibited a soft, pleasant feel.

I claim:

1. An article comprising an expandable compressed reticulated urethane foam impregnated with and bound in its compressed state by a fabric softener, said softener having a softening point in excess of about 38° C. and being water-dispersible at temperatures of from about 20° to about 85° C.

2. The article of claim 1 wherein the urethane foam is hydrophilic.

3. The article of claim 1 wherein the fabric softener is a quaternary ammonium salt.

4. The article of claim 1 wherein the fabric softener is an amine oxide.

5. The article of claim 1 wherein the fabric softener is a quaternary imidazolinium salt.

6. The process of conditioning fabrics in a wash or rinse cycle of an automatic washing machine which comprises adding to the water in said cycle an article comprising an expandable compressed reticulated urethane foam impregnated with and bound in its compressed state by a fabric softener, said softener having a softening point in excess of about 38° C. and being water-dispersable at temperatures of from about 20° to about 85° C.

7. The process according to claim 6 wherein the urethane foam is hydrophilic.

8. The process according to claim 6 wherein the fabric softener is a quaternary ammonium salt.

9. The process according to claim 6 wherein the fabric softener is an amine oxide.

10. The process according to claim 6 wherein the fabric softener is a quaternary imidazolinium salt.

* * * * *